United States Patent [19]

Chapman

[11] 4,071,238

[45] Jan. 31, 1978

[54] BASKETBALL GOAL ASSEMBLY

[76] Inventor: James E. Chapman, P.O. Box 559, Chester, Calif. 96020

[21] Appl. No.: 792,516

[22] Filed: May 2, 1977

[51] Int. Cl.[2] ..... A63B 63/00

[52] U.S. Cl. ..... 273/1.5 R

[58] Field of Search ..... 273/1.5 R, 1.5 A, 73 D

[56] References Cited

U.S. PATENT DOCUMENTS 1,526,734 2/1925 Andrews et al. ..... 273/73 D

FOREIGN PATENT DOCUMENTS 125,055 7/1947 Australia ..... 273/73 D 1,214,739 12/1970 United Kingdom ..... 273/1.5 R

*Primary Examiner*—Paul E. Shapiro

[57] ABSTRACT

A basketball goal for supporting a depending goal net having a plurality of cord loop portions comprising a goal ring having an upper surface and a lower surface, with the goal ring having a plurality of spaced apart slots extending peripherally around the ring and between the surfaces so as to receive a respective one of the cord loops therein. Each slot including a pair of side walls angularly displaced relative to each other outwardly from the lower surface towards the upper surface so as to provide an enlarged open end. A plurality of locking members dimensioned to simultaneously extend into each one of the grooves, with each locking member comprising a body element having oppositely disposed top and bottom ends and spaced apart edges intermediate the ends, and the edges being inclined relative to each other. The inclined edges of the body element being disposed in wedging relationship with the cord loop portions which are interposed between the inclined edges and the side walls so that upon the application of external forces to the goal net the locking members positively retain the goal net secured to the ring by means of the loops.

10 Claims, 4 Drawing Figures

BASKETBALL GOAL ASSEMBLY

BACKGROUND OF THE INVENTION

1. Field Of The Invention

The present invention relates to basketball hoops or goals, and more particularly to the means for attaching the goal net to the ring that is provided.

2. Description Of The Prior Art

There is contained in the prior art various forms of attaching the net of the basketball goal to the ring provided therefor. Examples of these types of prior art constructions are illustrated in U.S. Pat. Nos. 3,053,635; 3,666,641; 2,735,680; and 2,884,249. I have discovered that a simplified construction is obtainable by the utilization of locking members that are adapted to be positioned in spaced apart slots extending around the ring. In this manner the cord of the net becomes an interrelated element in the assembly to provide a simple and efficient assembly arrangement. The advantages and distinctions of my invention over the prior art will become more clearly evident as the disclosure proceeds.

OBJECTS OF THE INVENTION

An object of the present invention is to provide a basketball goal in which the plurality of cord loop portions are confined within the ring, such that the ring is free from any elements extending downwardly thereof. Other objects will become apparent as the disclosure proceeds.

SUMMARY OF THE INVENTION

A basketball goal for supporting a depending goal net having a plurality of cord loop portions comprising a goal ring having an upper surface and a lower surface, with the goal having a plurality of spaced apart slots extending peripherally around the ring and between the surfaces so as to receive a respective one of the cord loops therein. Each slot including a pair of side walls angularly displaced relative to each other outwardly from the lower surface towards the upper surface so as to provide an enlarged open end.

A plurality of locking members are provided and dimensioned to simultaneously extend into each one of the grooves, with each locking member comprising a body element having oppositely disposed top and bottom ends and spaced apart edges intermediate the ends, and the edges being inclined relative to each other. The inclined edges of the body element being disposed in wedging relationship with the cord loop portions which are interposed between the inclined edges and the side walls so that upon the application of external forces to the goal net the locking members positively retain the goal net secured to the ring by means of the loops.

The angle of inclination of the edges is substantially equal to that of the angularly displaced side walls, and the spacing between the ends of the body element is less than the spacing between the upper and lower surfaces of the ring, such that the cord of each loop extends in a plane of substantially the upper surface of the ring. The bottom end of each locking element extends in substantially the same plane as the lower surface of the ring. In addition, the width of the body element is narrower than the width of the slot, so as to be readily positioned therein, with the inclined side walls beig substantially equal length and extending at substantially the same angle of inclination.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
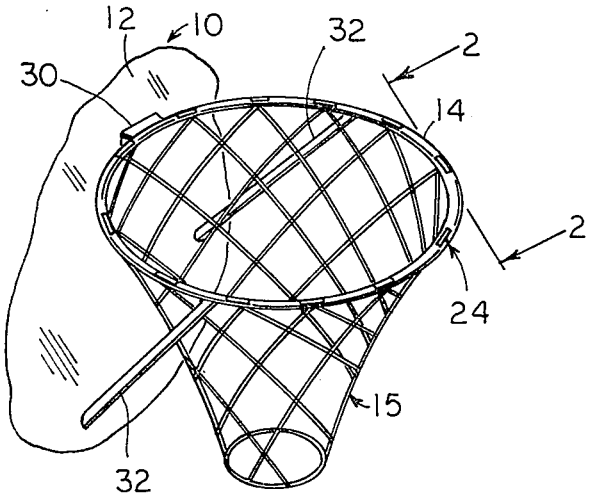
FIG. 1 is a perspective view of the basketball goal in accordance with the present invention.
Figure 2:
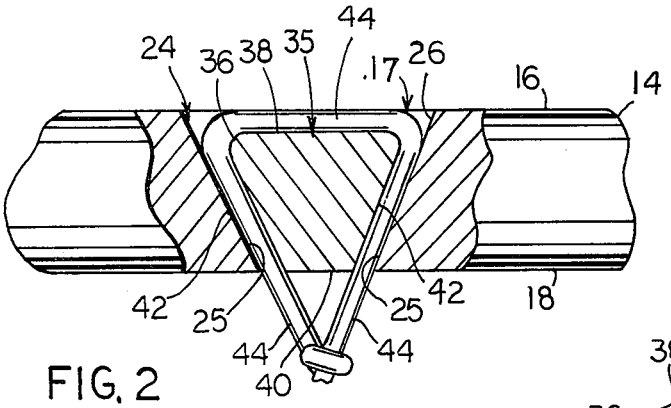
FIG. 2 is an enlarged fragmentary view, partly in section, illustrating the goal net in assembled relationship with the goal ring and locking member at one location thereof.
Figure 3:
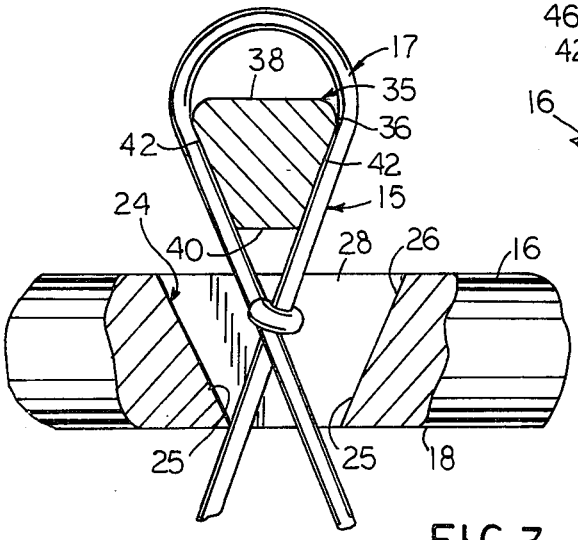
FIG. 3 is an exploded view, illustrating the assembling of the cord loop and locking member prior to positionment within the ring, as illustrated in FIG. 2.
Figure 4:
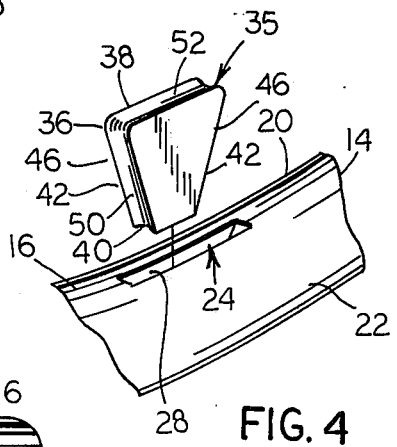
FIG. 4 is a fragmentary perspective view illustrating the locking member prior to being assembled within one of the slots in the ring.

Referring to the drawings, there is illustrated in FIGS. 1–4 a basketball goal identified by the numeral 10 which is mounted relative to a supporting surface 12. The basketball goal 10 includes a goal ring 14 and has mounted therefrom a goal net 15. The goal net 15 may be fabricated from rope or other type of material, and may be circular in cross section. The net 15 is fabricated as to include a plurality of spaced apart cord loop portions 17 at the upper end thereof, as illustrated in FIG. 3.

The goal ring 14 may be fabricated from metal and includes an upper surface 16 and lower surface 18. In addition, the ring 14 includes an inner surface 20 and outer surface 22. The surfaces 16, 18, 20, and 22 may have different shapes, and may be of circular cross section if desired.

In contrast to the prior art, it will be evident that there are no hooks or other members depending from any of the surfaces of the ring 14. The ring 14 includes a plurality of spaced apart slots 24. The exact number of slots 24 may vary depending upon the particular strnegth of the material from which the loops 17 are fabricated. The slots 24 extend peripherally around the ring 14 between the surfaces 16 and 18. Each slot 24 receives a respective one of the cord loops 17 therein.

Each slot 24 includes a pair of side walls 25 that are angularly displaced relative to each other outwardly from the lower surface 18 towards the upper surface 16 so as to provide an enlarged open end 26. Each slot 24 further includes end walls 28 that extend in spaced relationship to each other. The end walls 28 may extend in parallel spaced relationship to each other in a plane intermediate the inner and outer surfaces 20 and 22 respectively. Accordingly, the open ends 26 of each of the slots 24 extend in the direction of the annular configuration of ring 14. A bracket 30 may couple the ring 14 to surface 12, and a pair of outer brackets 32 may further extend between the ring 14 and the surface 12.

The inclined side walls 25 of the slot may be substantially of equal length and extend at substantially the same angle of inclination. In this manner the proper dimensional relationship of the slots 24 relative to locking members 35 is readily obtained.

The locking member 35 is dimensioned, to simultaneously extend into each one of the respective slots or grooves 24. Each locking member 35 includes a body element 36 having oppositely disposed top and bottom ends 38 and 40, respectively. Spaced apart edges 42 extend intermediate the ends 38 and 40. The edges 42 are inclined relative to each other and may be of substantially equal length and extend at substantially the same angle of inclination.

The angle of inclination of the edges 42 may be substantially equal to that of the angularly displaced side walls 25, as illustrated in FIG. 2. The length or vertical height of the body element 36 is selected to be less than the distance or spacing between the upper and lower surfaces 16 and 18 of the ring 14. This dimensional relationship is chosen such that the cord section 44 of each loop 17 extends in a plane substantially equal with the upper surface 16 of ring 14. Each locking member also includes a pair of spaced apart front and rear walls or surfaces 46. Surfaces 46 may extend in parallel spaced relationship to each other and define the width of the body element 36. The width of the body element 36 is narrower than the width of the slot 24 as defined by the end walls 28.

In this manner each body element 36 may be readily inserted into a corresponding slot 24 in the manner illustrated in FIG. 3. In addition, the inclined edges 42 of the body element 36 may include a recess 50. The recess 50 has a curvature substantially equal to the contour of the cord 44. In addition, the top end 38 may also include a recess 52 of similar curvature.

By providing the above arrangement, the inclined edges 42 of the body element 36 are disposed in wedging relationship with the cord loop portions 44, as illustrated in FIG. 2. The cord loop portions 44 being interposed between the inclined edges 25 and the side walls 42 such that upon the application of external forces to the goal net 15, the locking members 35 positively retain the goal net 15 secured to the ring 14 by means of the individual loops 17.

The dimensions of the body element 36 are such that the bottom end 40 may extend in substantially the same plane as the lower surface 18 of the ring 14. It is appreciated that the assembly procedure is readily accomplished by positioning each loop 17 through a slot 24 and thereafter inserting a locking member 35 in the position of FIG. 3. The cord sections 44 being received within the recess 50. Upon the downward force the wedging relationship takes place and each loop 17 is formed into the position illustrated in FIG. 2. If desired, the net 15 may be replaced from time to time, by individually forcing each locking member 35 from the assembled position of FIG. 2.

The proper coupling relationship is easily attained and the net 15 can extend in the same plane as surface 16 of ring 14. There are no hooks or other elements that could possibly injure or tear the skin, of a basketball player as he jumps up towards the net. This is in direct contrast to the above described prior art in which a depending element is utilized.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A basketball goal for supporting a depending goal net having a plurality of cord loop portions, comprising:

a. a goal ring having an upper surface and a lower surface, b. said goal ring having a plurality of spaced apart slots extending peripherally around said ring and between said surfaces so as to receive a respective one of the cord loops therein, c. each said slot including a pair of side walls angularly displaced relative to each other outwardly from said lower surface towards said upper surface so as to provide an enlarged open end, d. a plurality of locking members dimensioned to simultaneously extend into each one of said slots, each said locking member comprising a body element having oppositely disposed top and bottom ends and spaced apart edges intermediate said ends, said edges being inclined relative to each other, and e. said inclined edges of said body element being disposed in wedging relationship with the cord loop portions which are interposed between said inclined edges and said side walls so that upon the application of external forces to the goal net said locking members positively retain the goal net secured to said ring by means of the loops.

2. A basketball goal as in claim 1, wherein said angle of inclination of said edges is substantially equal to that of said angularly displaced side walls.

3. A basketball goal as in claim 1, wherein said spacing between said ends of said body element is less than the spacing between said upper and lower surfaces of said ring, such that the cord of each loop extends in a plane of substantially said upper surface of said ring.

4. A basketball goal as in claim 1, wherein said bottom end of each said locking member extends in substantially the same plane as said lower surface of said ring.

5. A basketball goal as in claim 1, wherein the width of said body element is narrower than the width of said slot, so as to be readily positioned therein.

6. A basketball goal as in claim 1, wherein said inclined side walls are of substantially equal length and extend at substantially the same angle of inclination.

7. A basketball goal as in claim 1, wherein said inclined edges of said body element are of substantially equal length and extend at substantially the same angle of inclination.

8. A basketball goal as in claim 1, wherein said inclined edges of said body element include a recess, said recess having a curvature substantially equal to the contour of the cord.

9. A basketball goal as in claim 8, wherein said top end of said body element includes a recess, said recess having a curvature substantially equal to the contour of the cord.

10. A basketball goal as in claim 1, wherein:

a. said ring includes an inner surface and an outer surface, b. said slots extending in a plane intermediate said inner and said outer surfaces.

c. said inclined side walls extend in a plane substantially normal to said inner and said outer surfaces, and d. bracket means for securing said ring to a support surface.

* * * * *